US008084412B2

(12) United States Patent
Burgess et al.

(10) Patent No.: US 8,084,412 B2
(45) Date of Patent: Dec. 27, 2011

(54) FABRIC TREATMENT COMPOSITION

(75) Inventors: Karl Burgess, Merseyside (GB); Uwe Hagemann, Brazil (BR); Barbara Ann Moore, Wirral (GB)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 13/050,984

(22) Filed: Mar. 18, 2011

(65) Prior Publication Data

US 2011/0173837 A1 Jul. 21, 2011

Related U.S. Application Data

(63) Continuation of application No. 11/667,774, filed on Jul. 17, 2008, now Pat. No. 7,932,223.

(30) Foreign Application Priority Data

Nov. 15, 2004 (GB) ..... 0425181.5

(51) Int. Cl.
*C11D 1/835* (2006.01)

(52) U.S. Cl. ..... 510/519

(58) Field of Classification Search ..... 510/519
See application file for complete search history.

(56) References Cited

U.S. PATENT DOCUMENTS

| | | | | |
|---|---|---|---|---|
| 5,480,567 | A * | 1/1996 | Lam et al. | 510/519 |
| 6,107,270 | A * | 8/2000 | Smith et al. | 510/516 |
| 6,793,684 | B1 * | 9/2004 | Jarvis et al. | 8/116.1 |
| 2003/0199416 | A1 * | 10/2003 | Fry et al. | 510/327 |
| 2005/0026808 | A1 * | 2/2005 | Mohammadi et al. | 510/515 |

FOREIGN PATENT DOCUMENTS

| | | |
|---|---|---|
| AU | 607664 | 9/1989 |
| JP | 2-22399 | 1/1990 |

* cited by examiner

*Primary Examiner* — John R Hardee
(74) *Attorney, Agent, or Firm* — Rimma Mitelman

(57) ABSTRACT

A heat activated fabric treatment composition comprising:

a) at least 1% by weight of one or more quaternary ammonium fabric softening materials, b) at least 1% by weight of a non-ionic surfactant, such that components a) and b) comprise at least 30% by weight of the composition, c) at least 20% by weight of a fatty component selected from fatty acids having a melting point of at least 40° C., fatty alcohols having a melting point of at least 40° C. and mixtures thereof, d) from 5 to 30% by weight water.

The composition is provided in a dispensing device which, in use, is attached to the internal panel of a tumble dryer.

17 Claims, No Drawings

FABRIC TREATMENT COMPOSITION

This is a continuation of U.S. application Ser. No. 11/667,774, filed Jul. 17, 2008, now U.S. Pat. No. 7,932,223.

FIELD OF THE INVENTION

The present invention relates to a fabric treatment composition. The invention particularly relates to a heat activated fabric treatment composition for use in a tumble dryer.

BACKGROUND OF THE INVENTION

Heat activated fabric treatment compositions for use in an automatic tumble dryer are described in our co-pending applications, WO-A-03/087285 and WO-A-03/087286, and devices suitable for use in the treatment fabrics in a tumble dryer are disclosed in our co-pending applications, WO-A1-02/33160 and WO-A1-02/33161.

In order to optimise the delivery of the active material onto fabrics during the drying cycle, it is desirable to provide a fabric treatment composition which, at a temperature below the heating cycle temperature of the tumble dryer, remains substantially within a dispensing article and is capable of undergoing a transition during the heating cycle of a tumble dryer such that it can be dispensed from the dispensing article.

It is, therefore, desirable to provide a fabric treatment composition which is capable of undergoing such transitions without unacceptable instability. It is particularly desirable that the composition can undergo such a cycle repeatedly.

Effective delivery of such a fabric treatment composition requires the composition to be flowable at the delivery temperature (i.e. the heating temperature of the tumble dryer).

Accordingly, it is desirable to provide a heat activated fabric treatment composition which can be delivered as a liquid during the heating cycle of a tumble dryer from a dispensing device.

It is further desirable to provide a heat activated fabric treatment composition which can be stored in a dispensing device and which can undergo repeated cycles from a more viscous storage state to a less viscous dispensable state such that during the heating cycle of the tumble dryer at least part of the composition is delivered to fabrics and during the storage state does not leak from the device.

The problem of leakage becomes a significant risk when the ambient storage temperature is close to the melting temperature of the composition.

Our copending British Patent Application No. 0420202.4 discloses a heat activated fabric treatment composition comprising:

(a) from 1 to 75 wt % of a quaternary ammonium fabric softening system which comprises:
  (i) a quaternary ammonium fabric softening material derived from a parent fatty acid or acyl compound having an average iodine value of from 0 to 19, and
  (ii) a quaternary ammonium fabric softening material derived from a parent fatty acid or acyl compound having an average iodine value of from 20 to 140
(b) from 5 to 60 wt % of a nonionic surfactant; and
(c) from 5 to 70 wt % of water, and its use in conditioning fabrics in a tumble dryer.

That composition addresses some of the above-mentioned problems.

OBJECTS OF THE INVENTION

The present invention seeks to provide alternative heat activated compositions having improved properties.

STATEMENT OF INVENTION

According to the invention there is provided a heat activated fabric treatment composition comprising:

a) at least 1% by weight of one or more quaternary ammonium fabric softening materials,
b) at least 1% by weight of a non-ionic surfactant, such that components a) and b) comprise at least 30% by weight of the composition,
c) at least 20% by weight of a fatty component selected from fatty acids having a melting point of at least 40° C., fatty alcohols having a melting point of at least 40° C. and mixtures thereof, and
d) from 5 to 30% by weight water.

DETAILED DESCRIPTION OF THE INVENTION

In the context of the present invention, "heat activated" means that composition is suitable for use in a domestic tumble dryer, and preferably means that the composition is substantially solid at ambient temperature, i.e. 20° C., and undergoes a transition to a substantially liquid state at the heating temperature of a domestic tumble dryer.

Since the heating temperature of a domestic tumble dryer is typically within the range from about 40° C. to about 80° C., it is particularly preferred that the composition is solid at 30° C., more preferably at 40° C. It is desirable that the composition is fully melted at temperatures above 50° C.

Product Form

In order to provide a fabric treatment composition capable of remaining substantially within a dispensing device during storage and being delivered to fabrics during the heating cycle of a tumble dryer, it is important that the composition has viscosity characteristics which allow the transition from a storage state to a dispensing state to occur at or about the heating temperature of the heat cycle. That is, the composition should preferably be a non-flowing, high viscosity product at ambient temperatures, e.g. a solid, and should become a low viscosity product, e.g. a liquid, at the heating temperatures of the tumble dryer.

Ideally, at the heating temperature the composition is a single phase or, if multi-phasic, the weight average particle size within the dispersed phase is smaller than a typical membrane pore size of a dispensing device. A typical membrane has a pore size in the range of 0.01-10 microns, though pore sizes outside this range may also be suitable. For instance, compressed foams and sinters may have larger pore sizes, e.g. up to 50 microns, or even higher.

The pore size should not be so small that dispensing becomes difficult and should not be so large pore sizes such that too much composition is released per drying cycle, thereby increasing the risk of staining.

At the heating temperature of a domestic tumble dryer, the composition will typically have a viscosity of below 350 mPa·s at 300 $s^{-1}$, more preferably below 300 mPa·s, most preferably below 250 mPa·s, e.g. below 200 mPa·s.

Measurements are made using a Haake PK100 Viscometer, 6 cm 2' cone and plate geometry The compositions of the invention are solid at 30° C., preferably at 35° C., more preferably at 40° C. These solid compositions have advantages over gel-like compositions in that they may readily be used to supply a reservoir of compositions for a device that is capable of delivering the composition in a controlled manner through at least 50, preferably at least 90 cycles of a tumble dryer. The use of such a large reservoir places considerable constraints on the composition. For example, the head pressure associated with a large volume of composition, particularly when the reservoir is full, coupled with a slow liquid to solid transition on cooling can cause unwanted dripping through the delivery device between cycles. This can be a particular problem with gel-like compositions. In addition composition in a large reservoir must be sufficiently stable to undergo many thermal cycles without becoming unstable.

a) Quaternary Ammonium Fabric Softening Material

The composition comprises at least one quaternary ammonium fabric softening material.

A first group of cationic fabric softening compounds which can be used is represented by formula (I):

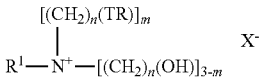

(I)

wherein each R is independently selected from a $C_{5-35}$ alkyl or alkenyl group, $R^1$ represents a $C_{1-4}$ alkyl, $C_{2-4}$ alkenyl or a $C_{1-4}$ hydroxyalkyl group, T is

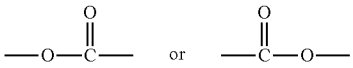

n is 0 or a number selected from 1 to 4, m is 1, 2 or 3 and denotes the number of moieties to which it relates that pend directly from the N atom, and $X^-$ is an anionic group, such as halides or alkyl sulphates, e.g. chloride, methyl sulphate or ethyl sulphate.

Preferred materials of this class are di-alkenyl esters of triethanol ammonium methyl sulphate.

Commercial examples include Tetranyl AHT-1 (di-hardened oleic ester of triethanol ammonium methyl sulphate 80% active), Tetranyl AT-1 (di-oleic ester of triethanol ammonium methyl sulphate 90% active), L5/90 (palm ester of triethanol ammonium methyl sulphate 90% active), all ex Kao, and Rewoquat WE15 ($C_{10}$-$C_{20}$ and $C_{16}$-$C_{18}$ unsaturated fatty acid reaction products with triethanolamine dimethyl sulphate quaternised 90% active), ex Witco Corporation and Stepantex VL85G ex Stepan.

The second group of cationic fabric softening compounds for use in the invention is represented by formula (II):

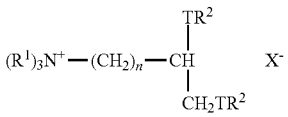

Formula (II)

wherein each $R^1$ group is independently selected from $C_{1-4}$ alkyl, hydroxyalkyl or $C_{2-4}$ alkenyl groups; and wherein each $R^2$ group is independently selected from $C_{8-28}$ alkyl or alkenyl groups; n is 0 or an integer from 1 to 5 and T and $X^-$ are as defined above.

A third group of cationic fabric softening compounds for use in the invention is represented by formula (III):

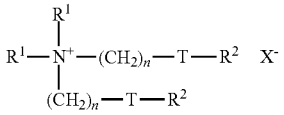

(III)

wherein each $R^1$ group is independently selected from $C_{1-4}$ alkyl, or $C_{2-4}$ alkenyl group; and wherein each $R^2$ group is independently selected from $C_{8-28}$ alkyl or alkenyl groups; n is 0 or an integer from 1 to 5 and T and $X^-$ are as defined above.

A fourth group of cationic fabric softening compounds for use in the invention is represented by formula (IV):

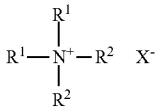

(IV)

wherein each $R^1$ group is independently selected from $C_{1-4}$ alkyl, or $C_{2-4}$ alkenyl groups; and wherein each $R^2$ group is independently selected from $C_{8-28}$ alkyl or alkenyl groups; and $X^-$ is as defined above.

The quaternary ammonium fabric softening material is present in an amount of at least 1% by weight (active ingredient) based on the total weight of the composition, preferably 5 to 50% by weight, most preferably 10 to 45% by weight.

Iodine Value of the Parent Fatty Acyl Group or Acid

In the context of the present invention, the iodine value of the parent fatty acyl compound or acid from which the fabric softening material formed, is defined as the number of grams of iodine which react with 100 grams of the compound.

The method for calculating the iodine value of a parent fatty acyl compound/acid comprises dissolving a prescribed amount (from 0.1-3 g) into about 15 ml chloroform. The dissolved parent fatty acyl compound/fatty acid is then reacted with 25 ml of iodine monochloride in acetic acid solution (0.1M). To this, 20 ml of 10% potassium iodide solution and about 150 ml deionised water is added. After addition of the halide has taken place, the excess of iodine monochloride is determined by titration with sodium thiosulphate solution (0.1M) in the presence of a blue starch indicator powder. At the same time a blank is determined with the same quantity of reagents and under the same conditions. The difference between the volume of sodium thiosulphate used in the blank and that used in the reaction with the parent fatty acyl compound or fatty acid enables the iodine value to be calculated.

b) Nonionic Surfactant

The nonionic surfactant is present in order to improve control of the melting temperature of the composition or at least to affect the temperature at which the composition flows.

It can also be present for other purposes. For instance, it has also been found to impart anti-static benefits to treated fabrics.

Preferred nonionic surfactants are solid at ambient temperature so that, once deposited onto fabrics, they cause greater scattering light from the fabrics thereby reducing visibility of any product deposited onto the fabric.

Furthermore, the preferred nonionic surfactants have an HLB within the range 8 to 20, more preferably 10 to 20, as this significantly improves solubilisation of the active components (such as fabric softening agents which typically have a solubility of less than $1\times10^{-3}$ wt % in water at 20° C.) in the water phase at the elevated temperatures of the heating cycle.

Suitable nonionic surfactants include addition products of ethylene oxide and/or propylene oxide with fatty alcohols, fatty acids and fatty amines.

Ideally, the nonionic surfactant comprises an average degree of alkoxylation of from 8 to 40 alkoxy units per molecule, more preferably 10 to 30, even more preferably 11 to 25, e.g. 12 to 22 alkoxy units.

Any of the alkoxylated materials of the particular type described hereinafter can be used as the nonionic surfactant.

Suitable surfactants are substantially water soluble surfactants of the general formula:

$$R—Y—(C_2H_4O)_z—C_2H_4OH$$

where R is selected from the group consisting of primary, secondary and branched chain alkyl and/or acyl hydrocarbyl groups; primary, secondary and branched chain alkenyl hydrocarbyl groups; and primary, secondary and branched chain alkenyl-substituted phenolic hydrocarbyl groups; the hydrocarbyl groups having a chain length of from 8 to about 25, preferably 10 to 20, e.g. 12 to 18 carbon atoms with coco and tallow or chain composition being most preferred.

In the general formula for the ethoxylated nonionic surfactant, Y is typically:

$$—O—,\ —C(O)O—,\ —C(O)N(R)— \text{ or } —C(O)N(R)R—$$

in which R has the meaning given above or can be hydrogen; and Z is preferably from 8 to 40, more preferably from 10 to 30, most preferably from 11 to 25, e.g. 12 to 22.

The degree of alkoxylation, Z denotes the average number of alkoxy groups per molecule.

The nonionic surfactant may be a polyol based surfactant such as sucrose mono-, di- and poly-esters. Examples of suitable sucrose esters include sucrose monooleates, sucrose monostearate or mixture thereof, poly glycerols, alkyl polyglucosides such as coco or stearyl monoglucosides and stearyl triglucoside and alkyl polyglycerols.

A preferred non-ionic surfactant is of the nominal formula:

$$R—O—(CH_2CH_2—O)_{20}H$$

where R is iso—$C_{13}H_{27}$.

Such material is commercially available from BASF under the trade name LUTENSOL TO 20.

Another preferred material is Genapol C200. The above nonionic surfactants are useful in the present compositions alone or in combination, and the term "nonionic surfactant" encompasses mixed nonionic surface active agents.

Sucrose based surfactants are highly suitable because of their higher hydration state relative to other alkoxylates.

The nonionic surfactant is present at a level of from at least 5% by weight based on the total weight of the composition, preferably from 10 to 50 wt %, most preferably from 15 to 45 wt %.

The nonionic surfactant is preferably present in an amount greater than the quaternary ammonium fabric softening material. The combined amount of the non-ionic surfactant and the quaternary ammonium fabric softening material is at least 20%, preferably 10 to 70%, more preferably from 30 to 60% by weight of the total composition.

Preferably the nonionic surfactant is present in a weight excess, more preferably in a molar excess relative to the quaternary ammonium fabric softening system.

Generally, the weight ratio of quaternary ammonium fabric softening system to nonionic surfactant is within the range from 2:1 to 1:100, preferably from 3:2 to 1:75, more preferably from 1:1 to 1:20, e.g. 2:3 to 1:5.

c) Fatty Component

The compositions of the present invention comprise a fatty component selected from fatty acids and fatty alcohols and mixtures thereof. The fatty acids and alcohols have a melting point of at least 40° C., preferably at least 50° C., most preferably in the range 55 to 65° C.

The fatty components are solid at ambient temperature so that, once deposited onto fabrics, they cause greater scattering light from the fabrics thereby reducing visibility of any product deposited onto the fabric.

Suitable fatty acids/alcohols have a carbon chain length of from 14 to 26 carbon atoms, more preferably 12 to 22, most preferably from 12 to 20 carbon atoms.

The fatty component acts as a structurant enabling the product to be formed as a stable, solid structure. Product melting point of above 30° C., preferably above 35° C. and more preferably above 40° C. may be attained by appropriate selection and concentration of the fatty component. In addition it has been found that the transition from solid to liquid and liquid to solid of the product occurs over a narrower temperature range compared to products absent or with a reduced fatty component. This is particularly advantageous to reduce the phenomenon of 'dripping' from the device when the tumble dryer cools down after it has finished its drying cycle.

The fatty component is present in an amount of at least 20%, preferably at least 25%, more preferably in the range 30 to 40% of the total composition. It is preferred, although not essential, that fatty acid is present since this material may additionally act as an antistatic agent.

Preferably both fatty acid and fatty alcohol are present. Generally, the amount of fatty acid is greater than the amount of fatty alcohol.

Preferred fatty acids include hardened tallow fatty acid (available under the tradename Pristerene, ex Uniqema) and hardened Palmitic acid (available under the trade name Prifrac 2960 ex Uniqema).

Preferred fatty alcohols include hardened tallow alcohol (available under the tradenames Stenol and Hydrenol, ex Cognis and Iaurex CS, ex Albright and Wilson) and behenyl alcohol, a C22 chain alcohol, available as Lanette 22 (ex Henkel).

d) Water

The compositions of the invention comprise water in an amount of from 5 to 30%, preferably 5 to 25%, more preferably 5 to 20% of the total composition.

The water-based nature of the compositions of the present invention is believed to help reduce staining and is unlike conventional tumble dryer sheets which are substantially non-aqueous.

When deposited onto fibre during the drying cycle, any water is preferably present as a continuous phase which may partially evaporate and/or remain partially associated with the active ingredient(s).

An unexpected benefit of water-based compositions is that the amount of staining is less dependent on the amount of delivery of the composition per heating cycle of the tumble dryer.

e) Solvent

Optionally and advantageously, the compositions comprise a solvent. The solvent may be present to aid dissolution of the quaternary ammonium softening materials and perfume. The solvent further optimises the viscosity and flow temperature characteristics of the composition.

Additionally, the solvent may act as a humectant retarding the loss of water from the composition upon storage.

Preferably the solvent is semi-polar.

Suitable solvents include any which have a flash point above the heating temperature of a tumble dryer. Ideally the solvent is also odourless.

Commercially available examples include polyols, such as glycol ethers. The most preferred solvent is dipropylene glycol.

The solvent is preferably present at a level of from 1 to 20% by weight, most preferably from 3 to 10% by weight, based on the total weight of the composition.

It is possible to replace all or part of the water with one or more solvents. In this case, a higher level of added solvent and lower level of water than described herein may be present in the composition.

Perfume

It is desirable that the compositions of the present invention also comprise one or more perfumes. Suitable perfume ingredients include those disclosed in "Perfume and Flavor Chemicals (Aroma Chemicals)", by Steffen Arctander, published by the author in 1969, the contents of which are incorporated herein by reference. A preferred perfume is commercially available under the trade name Amazone.

It has been found that up to 10 wt % perfume can be incorporated in the compositions of the present invention without destabilising the composition. Such levels are significantly higher than those present in commercially available tumble dryer sheets. Accordingly, better perfume substantivity and longevity can be achieved from the present compositions than from traditional tumble dryer sheets.

Thus, it is desirable that the level of perfume is greater than 3 wt %, more preferably greater than 4 wt %, most preferably greater than 5 wt %, based on the total weight of the composition.

Other Co-Active Ingredients

Other co-active ingredients for the fabric treatment active ingredient may also be incorporated in an amount from 0.01 to 20% by weight, more preferably 0.05 to 10%, based on the total weight of the composition. Preferred ingredients of this type include fatty esters, and fatty N-oxides.

Preferred fatty esters include fatty monoesters, such as glycerol monostearate. If GMS is present, then it is preferred that the level of GMS in the composition, is from 0.01 to 10 wt %, based on the total weight of the composition.

Polymeric Viscosity Control Agents

A polymeric viscosity control agent may also be present in the compositions of the invention. Suitable polymeric viscosity control agents include nonionic and cationic polymers, such as hydrophobically modified cellulose ethers (e.g. Natrosol Plus, ex Hercules) and cationically modified starches (e.g. Softgel BDA and Softgel BD, both ex Avebe). A particularly Preferred viscosity control agent is a copolymer of methacrylate and cationic acrylamide available under the tradename Flosoft 200 (ex SNF Floerger).

Polymeric viscosity control agents are preferably present in an amount of from 0.01 to 5 wt %, more preferably 0.02 to 4 wt %, based on the total weight of the composition.

Other Optional Ingredients

The compositions may also contain one or more optional ingredients conventionally included in fabric conditioning compositions such as pH buffering agents, perfume, perfume carriers, fluorescers, colourants, antifoaming agents, antiredeposition agents, polyelectrolytes, enzymes, optical brightening agents, anti-shrinking agents, anti-wrinkle agents, anti-spotting agents, germicides, fungicides, anti-bacterial agents, lubricants, solvents, anti-corrosion agents, drape imparting agents, ironing aids and dyes.

Examples

The invention will now be illustrated by the following non-limiting examples. Further modifications within the scope of the invention will be apparent to the person skilled in the art.

Samples of the invention are represented by a number. Comparative samples are represented by a letter.

All values are % by weight of the active ingredient unless stated otherwise.

Example 1

Comparative

The following compositions were prepared as follows. The nonionic surfactant and quaternary ammonium softening material were co-melted with stirring at 60° C. Dipropylene glycol followed by the perfume was then added, with stirring throughout. Demineralised water was heated to about 45° C. to 50° C. and added. The resulting mixture was stirred at 150 r.p.m. until homogeneous.

TABLE 1

| Ingredient | Sample A | Sample B |
|---|---|---|
| Softener[a] | 15.0[a] | 12.0 |
| Softener[b] | - | 3.0 |
| Nonionic Surfactant[c] | 40.0 | 39.0 |
| Dipropylene glycol | 5.25 | 5.15 |
| Perfume | 5.0 | 5.0 |
| Water | to 100 | to 100 |

[a]Stepantex VL85G, ex Stepan (85% active in 15% dipropylene glycol). A quaternary ammonium softening material based on triethanolamine. IV about 40.
[b]Stepantex X2508, ex Stepan (85% active in 15% dipropylene glycol). A quaternary ammonium softening material based on triethanolamine. IV less than 2.
[c]Genapol C200, ex Clariant, a Coco based Nonionic with an average of 20 ethoxylate groups Assessment A dispensing device—as described on page 16 line 26 to page 20 line 12 and shown in FIGS. 1, 3 and 4 of patent application WO-A-02/33161 having a membrane thickness of 160 μm, a Membrane pore size of 0.2 μm and membrane area of 1080 $mm^2$—was charged with 30 g of each of the samples.

The device was heated to a temperature of 60° C. for 2 to 3 hours until at least 80% of the front of the foam pad was visually "wetted" with the product (so as to simulate conditions in a typical tumble dryer). It was then allowed to cool and placed in an upright position. Control samples (100 g) were also placed into sealed containers.

The samples were stored at high temperatures for 3 days and visually assessed for physical state/leakage. The experiment was then repeated over 7 days.

The results are given in the following tables:

TABLE 2

| Storage Temperature (° C.) | Sample A (in device) | Sample A (in sealed container) |
|---|---|---|
| 45 | Significant dripping (within3 hours) | liquid |
| 37 | Dripping (within 24 hours) | solid |

TABLE 2-continued

| Storage Temperature (° C.) | Sample A (in device) | Sample A (in sealed container) |
|---|---|---|
| 33 | Dripping (within 1-3 days) | solid |
| 28 | Slight dripping (within 3-4days) | solid |

Surprisingly, even at temperatures where the comparative sample remained solid when stored in the sealed container, it suffered from leakage from the device.

TABLE 3

| Storage Temperature (° C.) | Sample B (stored in device) |
|---|---|
| 45 | Significant dripping (within 3 hours) |
| 37 | Slight dripping (within 2-3 days) |
| 33 | Trace dripping/moistness (within 4 days) |
| 28 | No dripping |

The results demonstrate that at temperatures below the typical operating temperature of a tumble dryer, sample B with a mixture of quaternary ammonium fabric softening materials exhibited significantly better storage stability than the comparative sample.

It is to be expected that dripping would be increased if the quantity of composition charged into the reservoir was significantly increased.

Example 2

The following compositions were prepared adopting the procedure of Example 1.

TABLE 4

| | | Percent (as received) | | | |
|---|---|---|---|---|---|
| Component | Trade name | Sample B | Sample 1 | Sample 2 | Sample 3 |
| Nonionic | Genapol C 200 | 39.00 | — | — | — |
| | Lutensol TO 20 | — | 20.00 | 20.00 | 40.00 |
| Cationic | Stepantex VL85G | 12.00 | 15.00 | 15.00 | 15.00 |
| | Stepantex X2508 | 3.00 | — | — | — |
| Solvent | Di propylene glycol | 5.25 | 4.00 | 8.00 | 4.00 |
| Fatty Acid | Prifrac 2960 | — | 20.00 | 20.00 | — |
| Tallow Alcohol | Stenol 1618L | — | 16.00 | 20.00 | 20.00 |
| Perfume | Amazone | 5.00 | 5.00 | 5.00 | 5.00 |
| Demin. Water | Water | 35.75 | 20.00 | 12.00 | 16.00 |

Lutensol TO 20 is an alcohol athoxylate comprising iso —$C_{1-3}$ alcohol with 20 ethoxylate groups. Although similar to Genapol C 200, tests have shown it to be less staining on fabrics.

Prifrac 2960 is palmitic acid ex Uniqema.

Stenol 1618L is tallow alcohol (cetearyl alcohol) ex Clariant.

The composition exhibited the following properties.

TABLE 5

| Parameter | Sample B | Sample 1 | Sample 2 | Sample 3 |
|---|---|---|---|---|
| Appearance at room temperatore | Soft solid, homogenous | Hard solid, homogenous | Hard solid, homogenous | Hard solid, homogenous |
| Visual melting point | 34-41° C. | 46-50° C. | 42-45° C. | 46-50° C. |
| Appearance above melting point | Homogenous liquid | Homogenous liquid | Homogenous liquid | Homo genous liquid |

The compositions were assessed as in Example 1 with the exception that 60 g of composition was charged in the reservoir. The results are given in the following Table.

TABLE 6

| Storage Temperature (° C.) | Sample B | Sample 1 | Sample 2 | Sample 3 |
|---|---|---|---|---|
| 45° C. | Severe dripped 1st day (8 g) | Severe dripped 1st day (3 g) | Severe dripped 1st day (11 g) | Severe dripped 2nd day (513 g) |
| 37° C. | Moderate dripped 1st day (4 g) | Trace dripped after 2 days (1 g) | Trace dripped 1st day (3 g) | Slight dripped 2nd day (3 g) |
| 33° C. | Slight dripped after 2 days (2 g) | Slight dripping on 7th day (0.5 g) | Slight dripping after 3 days (0.5 g) | Slight dripping after 3 days (0.5 g) |
| 28° C. | Slight dripping on 9th day | No dripping at 14 days | No dripping at 14 days | No dripping at 14 days) |

Comparing Examples 1 anti 2 (Sample B) shows that there is a greater tendency to drip with a greater amount of product in the reservoir.

The compositions of the invention exhibited significantly improved storage properties at 28° C. compared to Sample B. Furthermore the Samples of the invention exhibited less dripping at 33° C. and 37° C. than Sample B and provide better control at limiting dispensing to the hot part of the thermal cycle of a tumble dryer.

Example 3

Experiments were conducted to assess the capacity of materials and compositions to stain polyester. Polyester is widely accepted as the fabric that reveals staining the most.

Method of Application

All preparations were diluted to 10% solutions (in Isopropanol) and placed in a Comfort Refresh Spray Bottle (ref: PET Boston Round Tall Bottle 272484, Sprayette IV & 24/410 cap). The fabric (Pink pongee-polyester) was sprayed three times with the 10% solutions from distance of 30 cm; to deliver approx 1-1.5 g of test solution. Mass of product delivered was recorded and monitors were line dried. Monitor size—0.7×0.5 m.

All products were warm, 60° C., when applied to the fabric, this ensured all materials were fully solubilised on application.

The test was done in triplicate.

Assessment Protocol

Staining was assessed visually by two formulation team members. Monitors were assessed using the viewing cabinet in ACTI visual room, UV and D65 light was selected to view the monitors as the staining was more visible.

The monitors were assessed for the proportion of the cloth that was stained and the appearance of the stain. Monitors were also assessed in pairs with the least stained monitor being selected.

The results revealed:

Lutensol TO 20 has less propensity to stain than Genapol C200;

Prifrac 2960 and Stenol 1618L have less propensity to stain than Genapol C200;

Stenol 1618L has less propensity to stain than Lutensol TO 20 and Prifrac 2960;

Examples 1 to 3 have less propensity to stain than Sample B.

The presence of the fatty component in the compositions of the invention can help to reduce the staining propensity of the heat activatable compositions.

Example 4

The following compositions were prepared adopting the procedure of Example 1.

TABLE 8

| | | Percent (as received) | | | |
|---|---|---|---|---|---|
| Component | Trade name | Sample 5 | Sample 6 | Sample 7 | Sample 8 |
| Nonionic | Genapol C 200 | — | — | — | — |
| | Lutensol TO 20 | 20.00 | 20.00 | 20.00 | 20.00 |
| Cationic | Stepantex VL85G | 15.00 | 15.00 | 15.00 | 15.00 |
| | Stepantex X2508 | — | — | — | — |
| Solvent | Di propylene glycol | 4.00 | 4.00 | 4.00 | 4.00 |
| Fatty Acid | Pristerine 4911 | 20.00 | — | 36.00 | — |
| Fatty Acid | Prifrac 2960 | — | 36.00 | — | — |
| Tallow Alcohol | Stenol 1618L | 16.00 | — | — | 36.00 |
| Perfume | Amazone | 5.00 | 5.00 | 5.00 | 5.00 |
| Demin. Water | Water | 20.00 | 20.00 | 20.00 | 20.00 |

Pristerine 4911 is a fatty acid product ex. Uniqema comprising palmitic and hardened tallow acids.

Pristerine 4911 melts at a lower temperature than Prifrac 2960 and was easier to handle. Sample 5 was a hard, homogenous solid at room temperature and had an acceptable melting point and viscosity at elevated temperature.

Samples 6 to 8 use 36% fatty acid or 36% tallow alcohol. All samples were hard, homogenous solids at room temperature melting at temperatures slightly higher than Sample 2 and having acceptable viscosities 60 mPas+/−10 at 60° C.

The invention claimed is:

1. A heat activated fabric treatment composition comprising:

a) at least 1% by weight of one or more quaternary ammonium fabric softening materials which comprises a dialkenyl ester of triethanol ammonium methylsulfate, b) at least 1% by weight of a non-ionic surfactant of the nominal formula:

$$R—O—(CH_2—CH_2—O)_{20}H$$

Where R is iso $—C_{13}H_{27}$, such that components a) and b) comprise at least 30% by weight of the composition, c) at least 20% by weight of a fatty component selected from fatty acids having a melting point of at least 40° C., fatty alcohols having a melting point of at least 40° C. and mixtures thereof, d) from 0.01 to 5% by weight of a polymeric viscosity control agents, and e) from 5 to 30% by weight water.

2. A composition as claimed in claim 1 in which the quaternary ammonium fabric softening material is present in an amount of from 10 to 45% by weight.

3. A composition as claimed in claim 1 which comprises from 15 to 45% by weight of non-ionic surfactant.

4. A composition as claimed in claim 1 in which the combined amount of quaternary ammonium fabric softening material and non-ionic surfactant is from 30 to 60% by weight of the total composition.

5. A composition as claimed in claim 1 which comprises from 30 to 40% by weight of the fatty component.

6. A composition as claimed in claim 1 in which the fatty component comprises a mixture of fatty acid and fatty alcohol.

7. A composition as claimed in claim 6 in which the fatty acid is present in a greater amount than the fatty alcohol.

8. A composition as claimed in claim 1 in which the fatty acid is selected from palmitic acid and stearic acid.

9. A composition as claimed in claim 1 in which the fatty alcohol is tallow alcohol.

10. A composition as claimed in claim 1 which comprises from 5 to 20% by weight water.

11. A composition as claimed in claim 1 which additionally comprises from 1 to 20% by weight of a solvent.

12. A composition as claimed in claim 11 in which the solvent is di-propylene glycol.

13. A composition as claimed in claim 1 which comprises at least 3% by weight of perfume.

14. A package comprising the heat activated composition of claim 1 within a dispensing device.

15. A method of conditioning fabrics in a tumble dryer comprising locating the package of claim 14 on the internal panel of the door of the tumble dryer, inserting fabrics into the tumble dryer and operating the dryer to cause at least a part of the fabric treatment composition to be dispensed from the device onto the fabrics being dried so as to condition the fabrics.

16. A heat activated fabric treatment composition comprising:

(a) at least 1% by weight of one or more quaternary ammonium fabric softening materials which comprises a dialkenyl ester of triethanol ammonium methylsulfate, (b) at least 1% by weight of a non-ionic surfactant, such that components a) and b) comprise at least 30% by weight of the composition, (c) at least 20% by weight of a fatty component selected from fatty acids having a melting point in the range 55 to 65° C., fatty alcohols having a melting point in the range 55 to 65° C. and mixtures thereof, (d) from 0.01 to 5% by weight of a polymeric viscosity control agent, and (e) from 5 to 30% by weight water.

17. A heat activated fabric treatment composition comprising:

a) at least 1% by weight of one or more quaternary ammonium fabric softening materials which comprises a dialkenyl ester of triethanol ammonium methylsulfate, b) at least 1% by weight of a non-ionic surfactant, such that components a) and b) comprise at least 30% by weight of the composition, c) at least 20% by weight of a fatty component selected from fatty acids having a melting point of at least 40° C., fatty alcohols having a melting point of at least 40° C. and mixtures thereof, d) from 1 to 20% by weight of a solvent, e) from 0.01 to 5% by weight of a polymeric viscosity control agent, and from 5 to 30% by weight water.

* * * * *